US007261644B2

(12) United States Patent
Burrows

(10) Patent No.: US 7,261,644 B2
(45) Date of Patent: Aug. 28, 2007

(54) FACEPLATE GROOVE PATTERN FOR A GOLF CLUB PUTTER HEAD

(75) Inventor: Bruce D. Burrows, Valencia, CA (US)

(73) Assignee: BGI Acquisition, LLC, Indianapolis, IN (US)

( * ) Notice: Subject to any disclaimer, the term of this patent is extended or adjusted under 35 U.S.C. 154(b) by 262 days.

(21) Appl. No.: 11/045,887

(22) Filed: Jan. 27, 2005

(65) Prior Publication Data

US 2005/0209020 A1 Sep. 22, 2005

Related U.S. Application Data

(60) Provisional application No. 60/553,866, filed on Mar. 16, 2004, provisional application No. 60/539,489, filed on Jan. 26, 2004.

(51) Int. Cl.
*A63B 53/04* (2006.01)

(52) U.S. Cl. ..... 473/340; 473/342

(58) Field of Classification Search ..... 473/324–350
See application file for complete search history.

(56) References Cited

U.S. PATENT DOCUMENTS 3,064,975 A 11/1962 Smith
5,358,249 A * 10/1994 Mendralla ..... 473/331
5,618,239 A * 4/1997 Rife ..... 473/330
5,676,606 A 10/1997 Schaeffer et al.
5,720,674 A 2/1998 Galy
5,827,132 A 10/1998 Bamber
5,971,867 A 10/1999 Galy
6,017,280 A 1/2000 Hubert
6,083,118 A 7/2000 Martins et al.
6,217,461 B1 4/2001 Galy
6,440,009 B1 8/2002 Guibaud et al.
6,592,467 B1 * 7/2003 Gray ..... 473/332
6,663,497 B2 12/2003 Cameron
6,846,246 B2 * 1/2005 Asplund et al. ..... 473/327

* cited by examiner

*Primary Examiner*—Eugene Kim
*Assistant Examiner*—Alvin A Hunter, Jr.
(74) *Attorney, Agent, or Firm*—David B. Quick; Ice Miller LLP

(57) ABSTRACT

A golf club putter head includes a faceplate groove pattern configured to provide the putter head with an elevated center of gravity. In one preferred form, a club head body defines a faceplate having at least one and preferably multiple elongated grooves formed therein to extend generally in a heel-to-toe direction, with at least one groove positioned above a vertical mid-point of the club head body. The groove depths progressively increase in a top-to-bottom direction so that the putter head center of gravity is elevated to a position spaced above the vertical mid-point of the club head body. When striking a golf ball, the elevated center of gravity functions to minimize initial ball skidding and to promote early smooth ball roll toward a target such as a cup on a golf green.

5 Claims, 7 Drawing Sheets

FACEPLATE GROOVE PATTERN FOR A GOLF CLUB PUTTER HEAD

BACKGROUND OF THE INVENTION

This application claims the benefit of U.S. Provisional Applications 60/539,489, filed Jan. 26, 2004, and 60/553,866, filed Mar. 16, 2004.

This invention relates generally to improvements in golf club heads of the type used for putting strokes. More particularly, this invention relates to an improved golf club putter head having a faceplate groove pattern designed for minimizing initial post-impact ball skidding, and to promote early smooth post-impact rolling of a golf ball toward a target such as a cup on a golf green or the like.

Golf club putter heads are available in an extremely broad range of geometric shapes and sizes, with virtually every putter head design intended or otherwise promoted as encouraging or facilitating controlled and balanced impact with a golf ball to achieve improved directional accuracy and a corresponding stroke count reduction in a round of golf. In general, putter heads comprise a club head body mounted at a lower end of an elongated club shaft, with the club head body defining a forwardly presented faceplate for impact engagement with a golf ball. In many putter designs, the club head body is weighted or is otherwise associated with various appendages and components assembled therewith in attempts to enhance overall balance and control.

When a golf ball is putted, particularly over a distance of several feet or more, initial impact engagement by the putter head typically causes initial ball movement in the form of skidding with little or erratic ball rotation relative to the underlying putting surface. Following this initial skidding phase, which often continues for several feet of ball movement, the ball transitions to a smoother rolling movement over the putting surface. Unfortunately, ball skidding is associated with minimal ball movement control, and thereby detracts from overall putting accuracy.

The present invention is directed to an improved golf club putter head designed for minimizing initial ball skidding and thereby for promoting early smooth rolling movement of a putting stroke, thereby improving or enhancing overall putting directional control to achieve improved putting accuracy.

SUMMARY OF THE INVENTION

In accordance with the invention, an improved golf club putter head is provided with a faceplate groove pattern configured to create an elevated center of gravity located above a vertical mid-point of a club head body or faceplate formed thereon. When the improved putter head of the present invention is used to strike a golf ball in the course of executing a putting stroke, the elevated center of gravity functions to minimize initial ball skidding and to promote early smooth ball roll toward a target such as a cup on a golf green. As a result, overall directional accuracy is improved.

In one preferred form, the club head body is adapted for mounting onto a lower end of a golf club shaft, and defines a faceplate oriented for impact engagement with a golf ball. The faceplate includes at least one and preferably multiple elongated grooves formed therein to extend generally in a heel-to-toe direction, with at least one of said grooves positioned above a vertical mid-point of the club head body and/or faceplate. In one form, the groove depths progressively increase in a top-to-bottom direction, and the grooves are filled at least partially with a filler material having a specific gravity less than that of the material forming the club head body so that the putter head center of gravity is elevated to a position spaced above the vertical mid-point of the club head body and/or faceplate. By way of example, for use with a putter head body formed from stainless steel or the like, the grooves may be filled with a comparatively lighter material such as aluminum or a selected elastomer or epoxy or the like.

In one alternative preferred form, the faceplate grooves may progressively decrease in depth in a top-to-bottom direction, wherein these grooves are filled at least partially with a filler material having a specific gravity greater than the material forming the club head body so that the putter head center of gravity is again elevated to a position spaced above a vertical mid-point of the club head body and/or faceplate. By way of example, for use with a relatively lightweight club head body such as an aluminum-based material, the grooves may be filled with a comparatively heavier material such as stainless steel, or a selected elastomer or epoxy or the like loaded with weighted particles.

In another alternative preferred form, an array of vertically extending grooves of increasing depth in a top-to-bottom direction, or a combination of vertical and horizontally extending grooves of increasing depth in a top-to-bottom direction, may be used. These grooves may be filled with a comparatively lighter material such as aluminum or a selected elastomer or epoxy or the like. Other alternatives include vertically extending grooves of decreasing depth in a top-to-bottom direction, or a combination of vertical and horizontally extending grooves of decreasing depth in a top-to-bottom direction, wherein such grooves are filled with a comparatively heavier material such as stainless steel, or a selected elastomer or epoxy or the like loaded with weighted particles.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
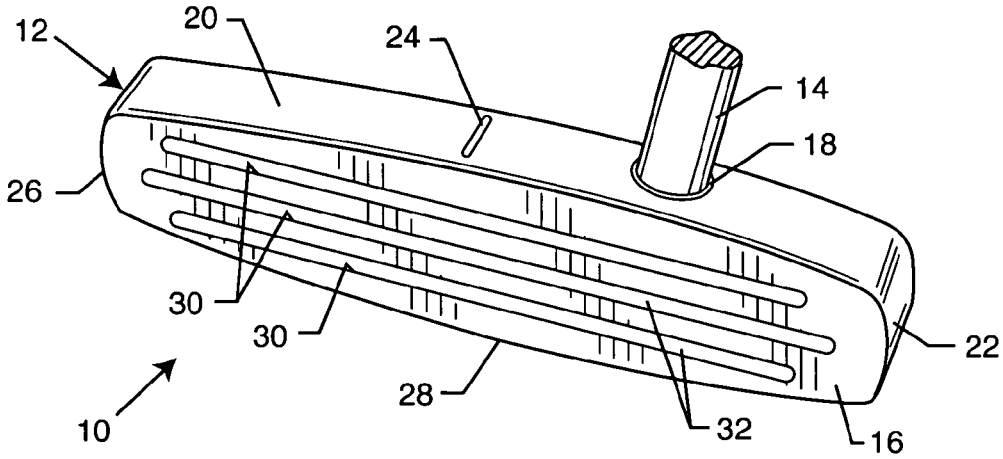
FIG. 1 is a front perspective view of a golf club putter head constructed in accordance with the present invention.
Figure 2:
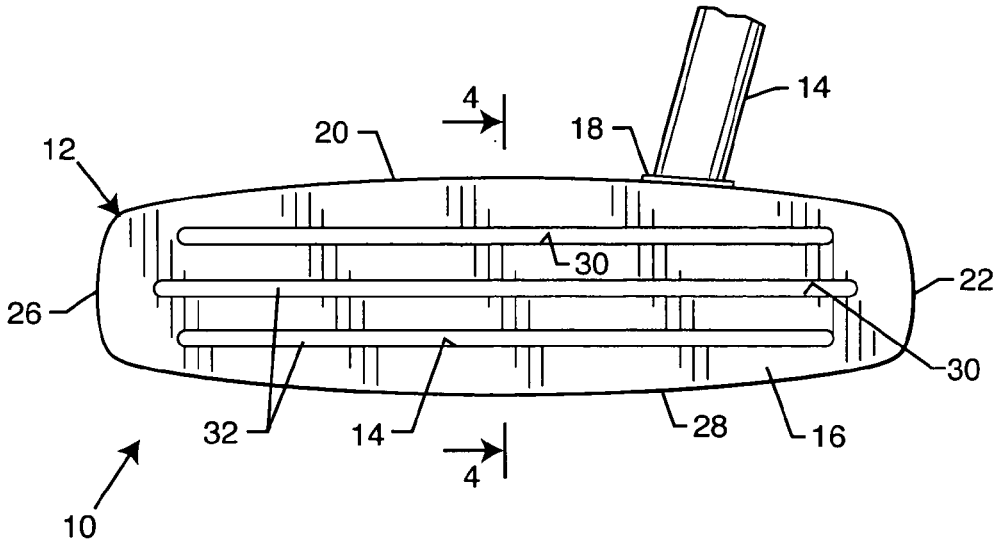
FIG. 2 is a front elevation view of the golf club putter head shown in FIG. 1.
Figure 3:
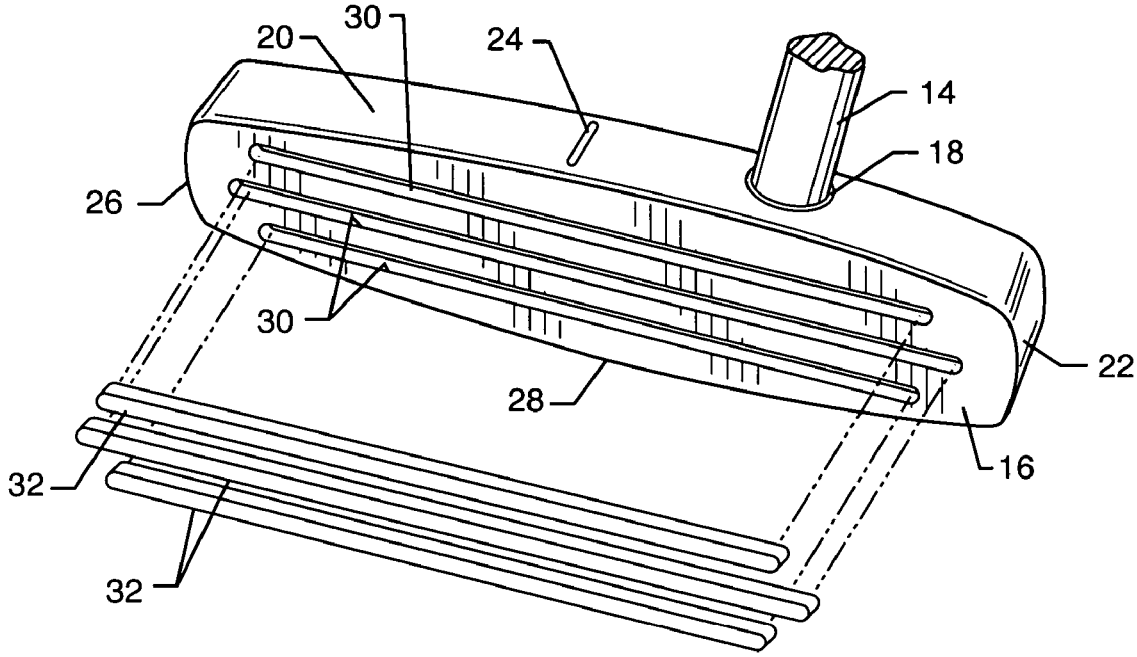
FIG. 3 is an exploded front perspective view of the golf club putter head of FIGS. 1 and 2.

As shown in the exemplary drawings, an improved golf club putter head referred to generally in FIGS. 1-4 by the reference numeral 10 includes a club head body 12 adapted for mounting onto a lower end of a golf club shaft 14. This club head body 12 defines a forwardly presented faceplate 16 for striking impact with a golf ball 11 (FIG. 4) in the course of executing a putting stroke during a round of golf or the like. In accordance with the invention, the club head body 12 is weighted so that a center of gravity thereof is vertically elevated to a position disposed at least slightly and preferably a short distance above a vertical mid-point of the faceplate 16 and/or the club head body 12. With this configuration, upon impact with a golf ball, initial and relatively uncontrolled or minimally controlled skidding of the ball is significantly reduced. Instead, early and comparatively smooth ball rolling is promoted to achieve improved directional control and improved putting accuracy.

The illustrative drawings show the club head body 12 in the form of one common block-shaped or blade-shaped configuration defining the forwardly presented faceplate 16 of generally or approximately rectangular shape which is significantly elongated in a lateral or heel-to-toe direction, and comparatively shorter in a vertical direction. The illustrative club head body 12 includes suitable means for secure attachment to the lower end of the club shaft 14, such as a hosel fitting 18 shown in an upper surface 20 thereof at a location offset laterally in a direction to a heel end 22 of the club head body 12. An alignment mark 24 is typically formed in or on the upper surface 20 of the body 12 generally at a lateral mid-point between the heel end 22 and an opposite toe end 26, for facilitated address and subsequent movement of the faceplate 16 into putting stroke engagement with a golf ball. The faceplate 16 extends substantially without interruption between the heel and toe ends 22, 26, and between the upper surface 20 and a lower or sole surface 28. Importantly, persons skilled in the art will recognize and appreciate that the illustrative club head body 12 exemplifies a broad range of different putter head geometric sizes and shapes each to include the forwardly presented faceplate 16 for impact engagement with a golf ball.

In one preferred form of the invention, vertical elevation of the center of gravity of the putter head 10 is achieved by forming at least one and preferably a plurality of elongated grooves 30 in the faceplate 16, wherein these groove 30 extend generally horizontally or in a heel-to-toe direction, and further wherein at least one of these grooves 30 is positioned above a vertical mid-point of the club head body 12 and/or faceplate 16. FIGS. 1-4 show three such grooves 30, with a central groove disposed substantially at the vertical mid-point of the club head body 12 and the faceplate 16 formed thereby. Accordingly, in this arrangement, an upper groove 30 is positioned above this vertical mid-point, and a lower groove 30 is formed below this mid-point. As viewed best in FIG. 4, the depths of these multiple grooves 30 progressively increase in a top-to-bottom direction. That is, the upper groove is shallower than the central groove, which is in turn shallower than the lower groove. The length and height dimensions of the multiple grooves 30 may otherwise be the same or nearly the same.

Figure 4:
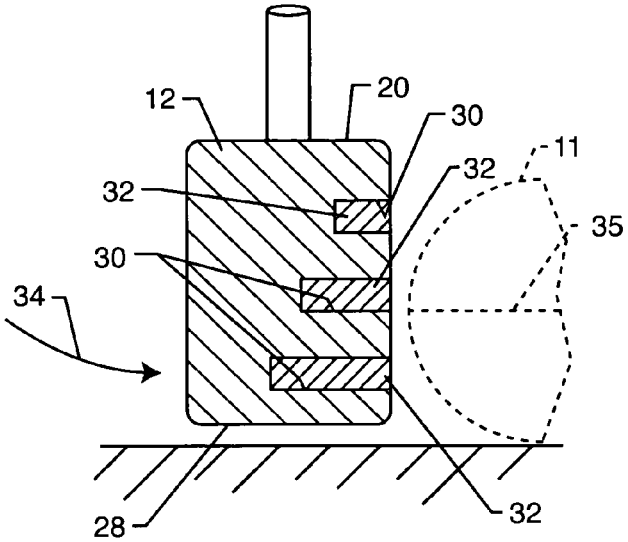
FIG. 4 is an enlarged fragmented vertical sectional view taken generally on the line 4-4 of FIG. 2.

Accordingly, in this configuration as depicted in FIG. 4, the grooves 30 defines voids in the club head body 12 that result in upward shifting or elevation of the center of gravity to a location spaced above the vertical mid-point of the club head body. In the preferred form of the invention, these grooves 30 are filled, or at least partially filled, with a filler material 32 that is comparatively lightweight relative to the material forming the club head body 12. In one form of the invention, where the club head body 12 is formed from a metal material such as stainless steel or the like, the filler material 32 is selected to have a comparatively lighter-weight specific gravity such as aluminum or magnesium or an alloy thereof, or such as a suitable elastomer or epoxy material.

The resultant putter head 10 (FIGS. 1-4) thus exhibits a vertically elevated center of gravity. When the putter head 10 in swung by a golfer (not shown) in the direction of arrow 34 in FIG. 4 to impact a golf ball 11, the center of gravity of the putter head 10 is positioned at least a short distance above a center of gravity of the golf ball 11, as referenced by axis 35 thereof in FIG. 4. This putter head configuration, relative to the golf ball 11, has been found to promote early transition of the golf ball from an initial skidding phase to a smooth rolling phase as the ball moves toward a target such as a cup on a golf green or the like. Conversely, the conventional initial skidding phase is minimized and in some cases substantially eliminated. As a result, golfer control over putted ball direction is significantly enhanced to correspondingly results in improved putting accuracy and improved golf scores.

Figure 5:
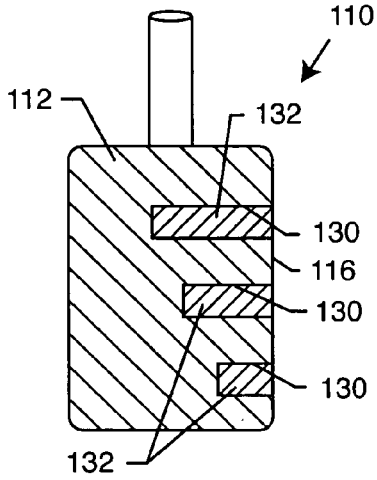
FIG. 5 is a fragmented sectional view similar to FIG. 4, but illustrating an alternative preferred form of the invention.

FIG. 5 illustrates one alternative preferred form of the invention, wherein components corresponding structurally and/or functionally with those previously described relative to FIGS. 1-4 are identified by common reference numerals increased by 100. As shown, a modified putter head 110 has multiple grooves 130 formed in the faceplate 116 of a club head body 112, similar to the embodiment of FIGS. 1-4, but wherein these grooves 130 are formed with depths that decrease progressively in the top-to-bottom direction. In other words, an upper groove is deeper than a central groove, which is in turn deeper than a lower groove, with the length and height dimensions of the multiple grooves 130 being otherwise the same or nearly the same. In this version of the invention, the center of gravity of the club head body 112 is initially shifted downward relative to a vertical mid-point thereof. However, in this version, the grooves 130 are filled with a filler material 132 that is comparatively heavier relative to the material forming the club head body 112. In one such form of the invention, where the club head body 112 is formed from a lightweight metal material such as aluminum or titanium or an alloy thereof, the filler material 132 is selected to have a comparatively heavier-weight specific gravity such as stainless steel, or a suitable elastomer or epoxy loaded with weighted particles or the like. The resultant putter head 110 exhibits an overall center of gravity that is elevated relative to a vertical mid-point of the club head body and/or faceplate.

Figure 6:
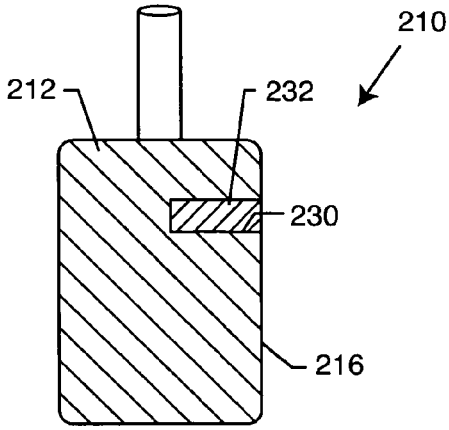
FIG. 6 is a fragmented sectional view similar to FIGS. 4 and 5, but depicting a further alternative preferred form of the invention.

FIG. 6 illustrates another alternative preferred form of the invention, wherein components corresponding structurally and/or functionally with those previously described relative to FIGS. 1-4 are identified by common reference numerals increased by 200. As shown, a single groove 230 is formed in the faceplate 216 of a club head body 212, similar to the embodiment of FIGS. 1-4, but wherein this single groove 230 is formed at a location vertically above a vertical mid-point of the club head body 212 and/or the faceplate 216 thereon. This single groove 230 may be filled at least partially with a filler material 232 that is comparatively heavy relative to the material forming the club head body 212, with exemplary material being disclosed relative to the embodiment of FIG. 5. The resultant putter head 210 exhibits an overall center of gravity that is elevated relative to a vertical mid-point of the club head body and/or faceplate.

A further alternative form of the invention may incorporate a single groove formed in the club head faceplate at a location below the vertical mid-point thereof, wherein such single low-positioned groove may be unfilled, or otherwise filled with a filler material that has a specific gravity less than that of the material forming the club head body. Exemplary materials for this configuration are described relative to the embodiment of FIGS. 1-4.

In each of the embodiments shown and described herein, persons skilled in the art will recognized that the filler material within each of the faceplate grooves may substantially entirely fill the grooves, thereby terminating substantially at the plane of the faceplate. Or, if desired, the filler material may partially fill the grooves so that a residual shallow recess (not shown) remains at the front of each groove. As a further alternative, in the embodiments of FIGS. 1-4, the grooves may remain unfilled. As a still further alternative, multiple grooves of substantially uniform depth may be formed at vertically spaced positions in the faceplate, but wherein these grooves are filled or partially filled with materials having different specific gravities to provide the club head with an elevated center of gravity.

Figure 7:
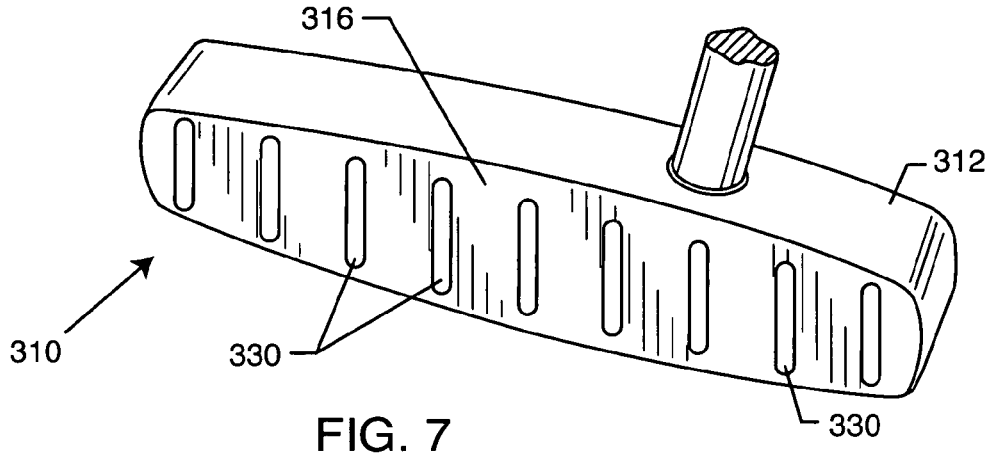
FIG. 7 is a front perspective view showing a further alternative preferred form of the invention.
Figure 8:
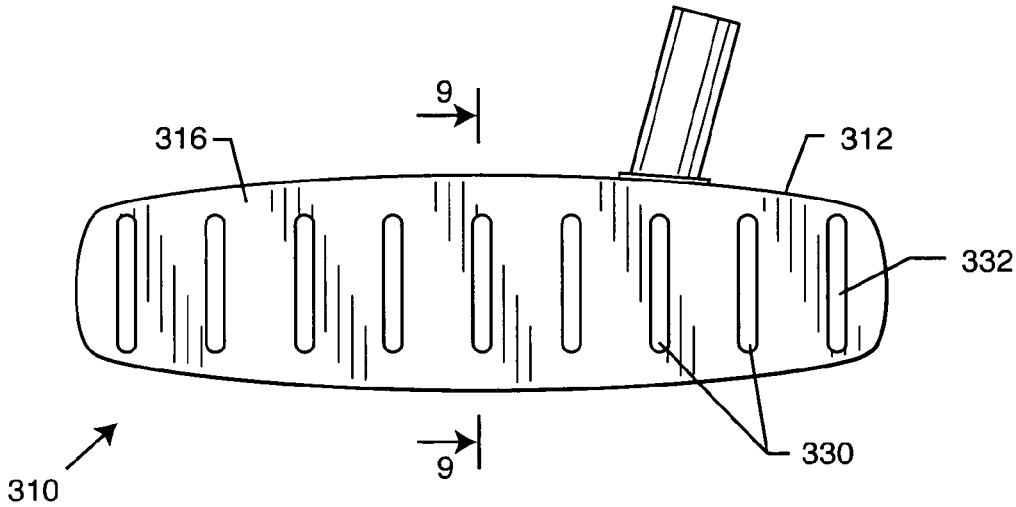
FIG. 8 is a front elevation view of the embodiment of FIG. 7.
Figure 9:
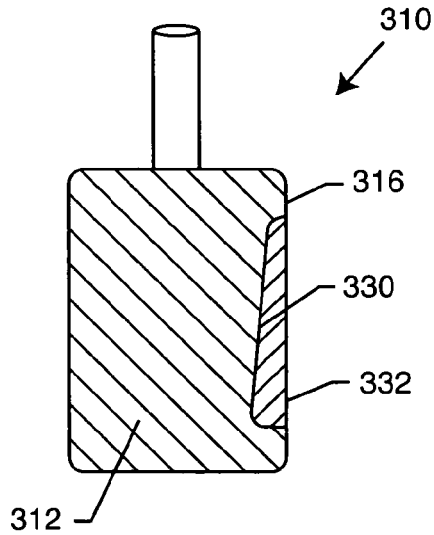
FIG. 9 is a vertical sectional view taken generally on the line 9-9 of FIG. 8.
Figure 10:
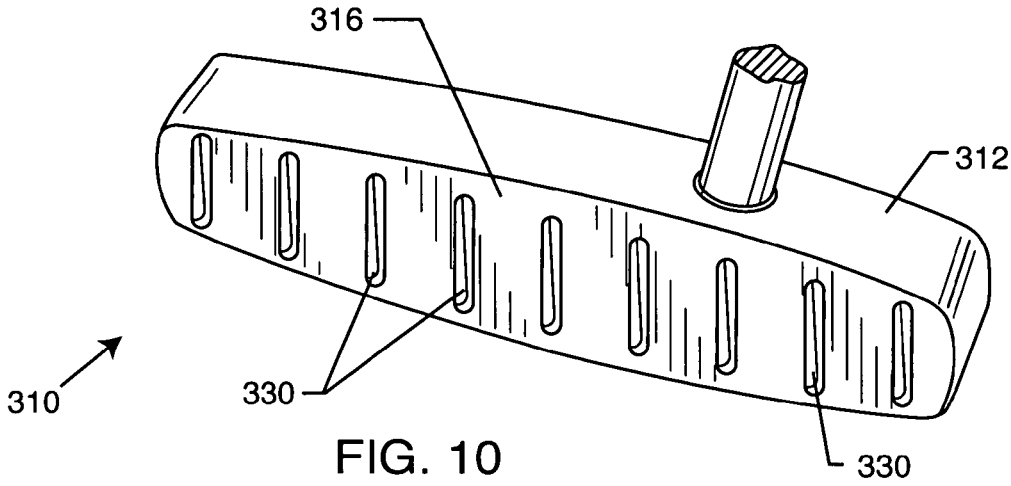
FIG. 10 is a front perspective view showing another alternative preferred form of the invention.
Figure 11:
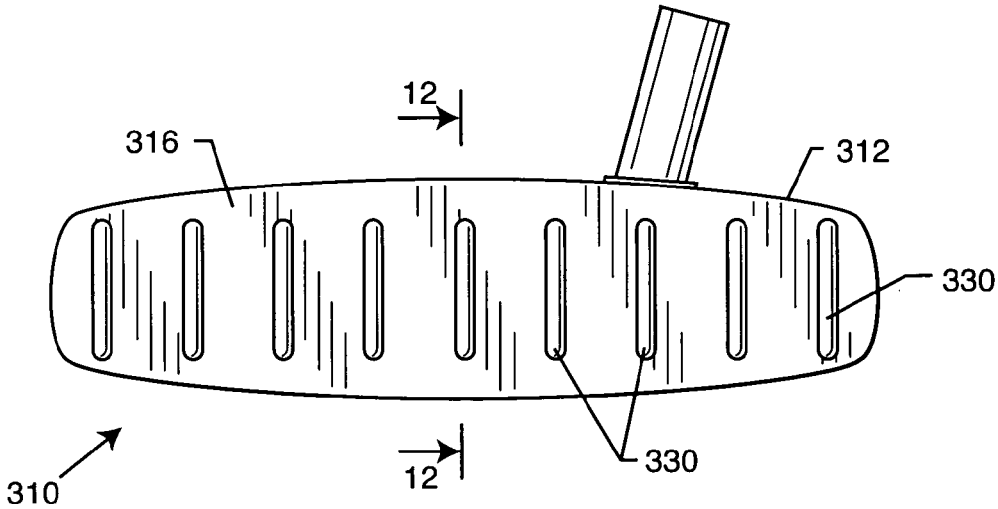
FIG. 11 is a front elevation view of the embodiment of FIG. 10.
Figure 12:
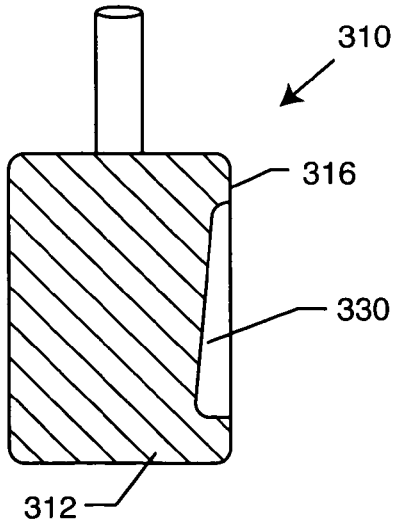
FIG. 12 is a vertical sectional view taken generally on the line 12-12 of FIG. 11.
Figure 13:
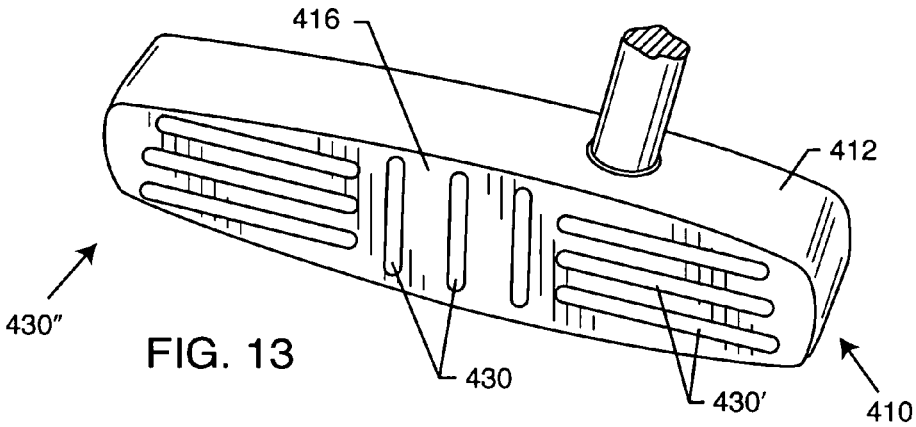
FIG. 13 is a front perspective view depicting still another alternative preferred form of the invention.
Figure 14:
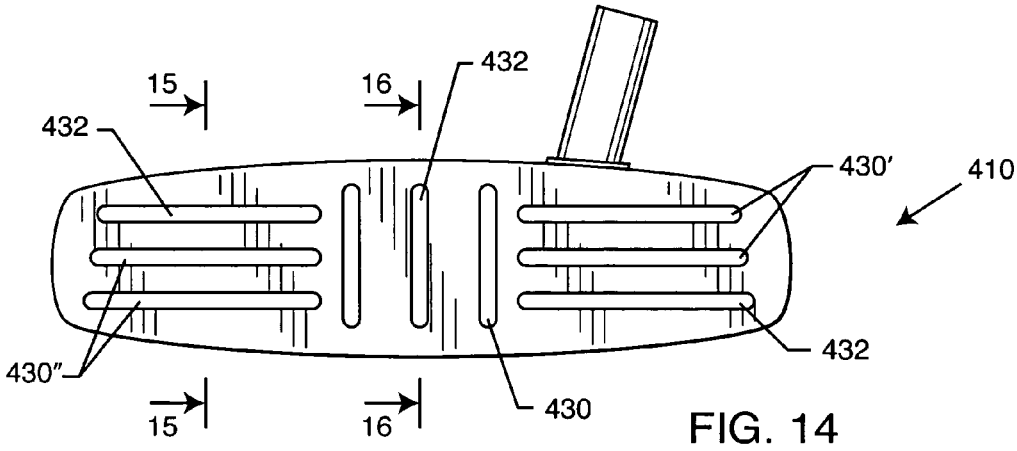
FIG. 14 is a front elevation view of the embodiment of FIG. 13.
Figure 15:
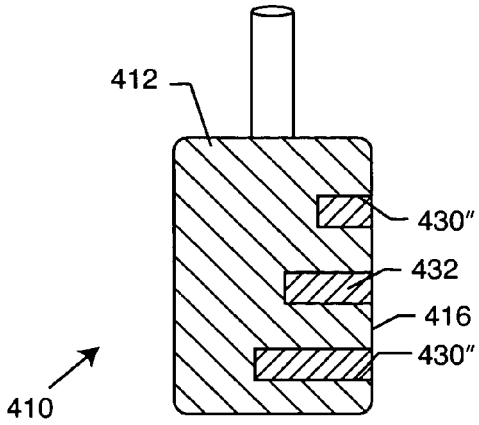
FIG. 15 is a vertical sectional view taken generally on the line 15-15 of FIG. 14.
Figure 16:
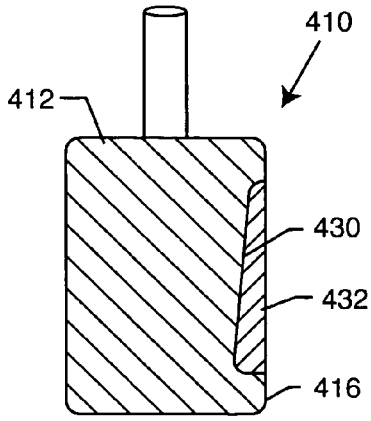
FIG. 16 is a vertical sectional view taken generally on the line 16-16 of FIG. 14.
Figure 17:
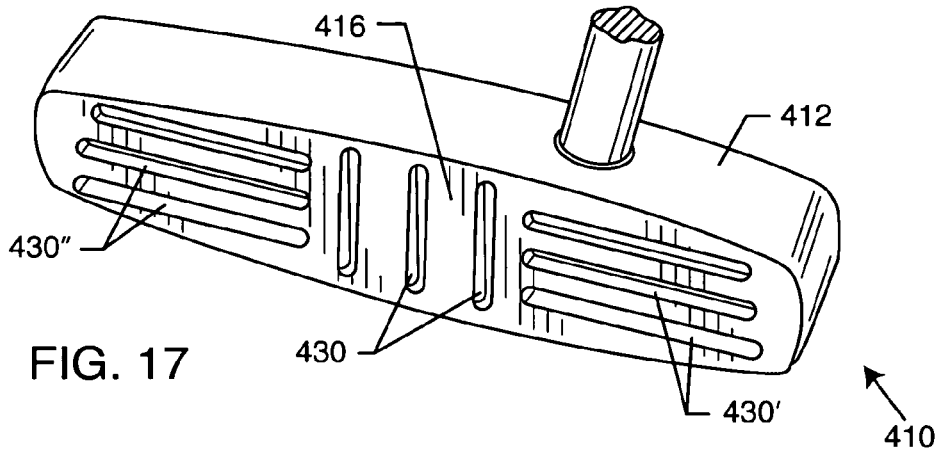
FIG. 17 is a front perspective view illustrating yet another alternative preferred form of the invention.
Figure 18:
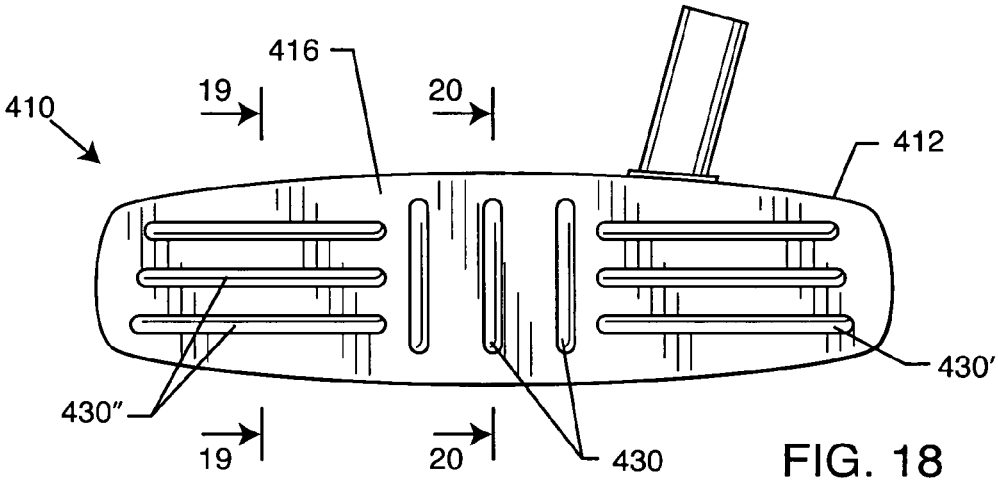
FIG. 18 is a front elevation view of the embodiment of FIG. 17.
Figure 19:
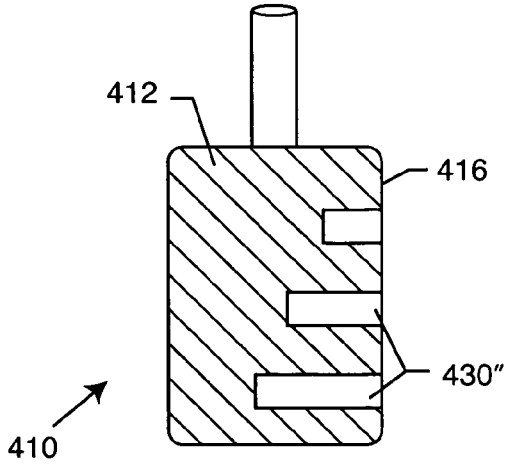
FIG. 19 is a vertical sectional view taken generally on the line 19-19 of FIG. 18.
Figure 20:
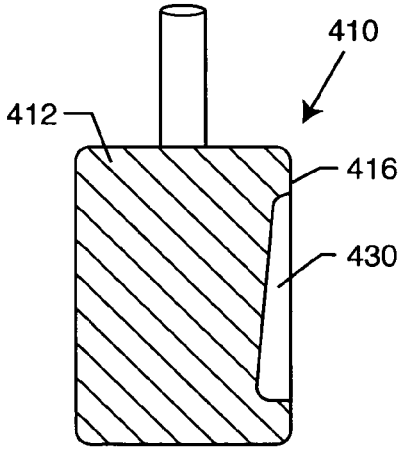
FIG. 20 is a vertical sectional view taken generally on the line 20-20 of FIG. 19.

FIGS. 7-12 depict a further alternative preferred form of the invention, wherein components corresponding structurally and/or functionally with those previously described relative to FIGS. 1-4 are identified by common reference numerals increased by 300. As shown, an array of vertically extending grooves 330 are formed in horizontally spaced relation across the faceplate 316 of the body 312 of the modified putter head 310. In this embodiment, the vertical grooves 330 are formed with variable depth that increases from top-to-bottom, resulting in a putter head 310 having a elevated center of gravity. FIGS. 7-9 show these variable-depth grooves 330 filled or partially filled with a filler material 332 that is comparatively lightweight relative to the material forming the club head body 312 (as described with respect to FIGS. 1-4), whereas FIGS. 10-12 show these grooves 330 in an unfilled state. Persons skilled in the art will recognize that the grooves 330 may be inverted, that is, provided with a variable depth that decreases in a top-to-bottom direction, in which case the grooves would be filled or partially filled with a filler material that is comparatively heavier relative to the material forming the club head body 312.

FIGS. 13-20 depict a further alternative preferred form of the invention, wherein components corresponding structurally and/or functionally with those previously described relative to FIGS. 1-4 are identified by common reference numerals increased by 400. As shown, an array of vertically extending grooves 430 are formed in horizontally spaced relation across a central region of the faceplate 416 of the body 412 of the modified putter head 410, in generally centered relation between a pair of horizontally extending groove arrays 430' and 430" formed in the faceplate 416 toward the heel and toe ends of the putter head 410, respectively. In this embodiment, the vertical set of grooves 430 are again formed with variable depth that increases from top-to-bottom, resulting in a putter head 410 having an elevated center of gravity. The horizontal sets of grooves 430' and 430" are also formed with increasing depth in a top-to-bottom direction, in the same manner as shown and described with respect to FIG. 1-4. The combined vertical grooves 430 and horizontal grooves 430' and 430" thus cooperate to provide the putter head 410 with an elevated center of gravity. FIGS. 13-16 show these variable-depth vertical grooves 430 and the horizontal grooves 430' and 430" filled or partially filled with a filler material 432 that is comparatively lightweight relative to the material forming the club head body 412 (as described with respect to FIGS. 1-4), whereas FIGS. 17-20 show these grooves 430, 430' and 430" in an unfilled state. Persons skilled in the art will recognize that the grooves 430 can be filled with the filler material 432, and the grooves 430' and 430" unfilled, or vise versa. Similarly persons skilled in the art will recognize that the groove depths may be inverted, that is, provided with a variable depth that decreases in a top-to-bottom direction, in which case the grooves would be filled or partially filled with a filler material that is comparatively heavier relative to the material forming the club head body 412.

A variety of further modifications and improvements in and to the improved golf club putter head of the present invention will be apparent to those persons skilled in the art. Accordingly, no limitation on the invention is intended by way of the foregoing description and accompanying drawings, except as set forth in the appended claims.

What is claimed is:

1. A golf club putter head, comprising: a putter head body defining a heel end, a toe end, a top surface, a bottom surface, and a faceplate for striking impact with a golf ball, said faceplate having at least one groove formed therein at a position and with a depth for elevating the center of gravity of said body to a position disposed above a vertical mid-point of said body wherein said at least one groove extends generally in a heel-to-toe direction and is formed in said faceplate at a position disposed below the vertical mid-point of said body, and further wherein said at least one groove is at least partially filled with a filler material having a specific gravity greater than the specific gravity of said body.

2. A golf club putter head, comprising: a putter head body defining a heel end, a toe end, a top surface, a bottom surface, and a faceplate for striking impact with a golf ball, said faceplate having at least one groove formed therein at a position and with a depth for elevating the center of gravity of said body to a position disposed above a vertical mid-point of said body and further wherein said at least one groove comprises a plurality of grooves each extending generally in a heel-to-toe direction, with at least one of said grooves being positioned at a location disposed below the vertical mid-point of said body, said grooves having a depth decreasing progressively in a top to bottom direction, and further wherein said grooves are at least partially filled with a filler material having a specific gravity greater than the specific gravity of said body.

3. A golf club putter head, comprising: a putter head body defining a heel end, a toe end, a top surface, a bottom surface, and a faceplate for striking impact with a golf ball, said faceplate having at least one groove formed therein at a position and with a depth for elevating the center of gravity of said body to a position disposed above a vertical mid-point of said body, wherein said at least one groove is formed in said faceplate to extend generally vertically between said top and bottom surfaces, said at least one groove having a variable depth for elevating the center of gravity of said body, and further wherein said at least one groove has a depth decreasing progressively in a top to bottom direction, and further wherein said at least one groove is at least partially filled with a filler material having a specific gravity greater than the specific gravity of said body.

4. A golf club putter head, comprising: a putter head body defining a heel end, a toe end, a top surface, a bottom surface, and a faceplate for striking impact with a golf ball, said faceplate having a plurality of grooves formed therein to extend generally in a heel-to-toe direction and having a depth for elevating the center of gravity of said body to a position disposed above a vertical mid-point of said body wherein at least one of said grooves is positioned at a location disposed below the vertical mid-point of said body, said grooves having a depth decreasing progressively in a top to bottom direction, and further wherein said grooves are at least partially filled with a filler material having a specific gravity greater than the specific gravity of said body.

5. A golf club putter head, comprising: a putter head body defining a heel end, a toe end, a top surface, a bottom surface, and a faceplate for striking impact with a golf ball, said faceplate having a plurality of grooves formed therein to extend generally in a vertical direction and having a variable depth for elevating the center of gravity of said body to a position disposed above a vertical mid-point of said body and wherein said grooves each have a depth decreasing progressively in a top to bottom direction, and further wherein said at least one groove is at least partially filled with a filler material having a specific gravity greater than the specific gravity of said body.

* * * * *